United States Patent [19]

Fry

[11] Patent Number: 4,459,713

[45] Date of Patent: Jul. 17, 1984

[54] DOUBLE WIDTH CHAISE LOUNGE

[76] Inventor: Raymond A. Fry, 146 Pile St., Ramona, Calif. 92065

[21] Appl. No.: 413,408

[22] Filed: Aug. 31, 1982

[51] Int. Cl.[3] ..... A47C 19/00

[52] U.S. Cl. ..... 5/211; 5/226; 5/110

[58] Field of Search ..... 5/110, 111, 186 R, 187, 5/211, 212, 226, 305; 297/378, 356

[56] References Cited

U.S. PATENT DOCUMENTS

| | | | |
|---|---|---|---|
| D. 90,866 | 10/1933 | Bielecky | D6/38 |
| D. 233,493 | 11/1974 | Tuttle | D6/38 |
| D. 261,705 | 11/1981 | Land | D6/38 |
| 1,815,495 | 7/1931 | Chittim | 5/226 |
| 2,567,626 | 9/1951 | Trouslot | 297/294 |
| 2,644,959 | 7/1953 | Blanke et al. | 5/305 |
| 2,855,025 | 10/1958 | Griffith | 297/118 |
| 3,206,774 | 9/1965 | Bertram | 5/110 |
| 3,822,422 | 7/1974 | Buntyn | 5/110 |
| 3,913,978 | 10/1975 | Lester | 5/186 R |

FOREIGN PATENT DOCUMENTS

| | | | |
|---|---|---|---|
| 1212361 | 3/1960 | France | 5/110 |

*Primary Examiner*—Alexander Grosz
*Assistant Examiner*—Michael F. Trettel
*Attorney, Agent, or Firm*—Kerkam, Stowell, Kondracki & Clarke

[57] ABSTRACT

A chaise lounge includes an adjustable strap extending lengthwise for varying the support provided to a user or users of the chaise lounge. The chaise lounge is sufficiently wide to accommodate two adults either sitting or lying side by side. Diagonal side-braces are used for providing sufficient structural strength to support the two adults and maintain the frame against the tension of the support strap.

5 Claims, 3 Drawing Figures

DOUBLE WIDTH CHAISE LOUNGE

BACKGROUND OF THE INVENTION

1. Field of the Invention

This invention relates to a chaise lounge. More particularly, this invention relates to a chaise lounge adapted to hold two people simultaneously.

2. Description of the Prior Art

The use of chaise lounges is well known in the art. Such chaise lounges typically have a center section and two end sections. The center section is pivotally attached to the two end sections such that the two end sections may be adjusted to be planar in a cot-like configuration with the center section for allowing a user to lie on the chaise lounge for sunbathing. The lounge may alternately be adjusted to a recliner configuration such that one end section supports the user's back in an upright position whereas the other end section extends downwardly for supporting the user's legs.

In addition to the chaise lounge, numerous other types of outdoor furniture have heretofore been used. However, the chaise lounge having pivotally adjustable end sections has been very popular because of its great adaptability.

The following patents are illustrative of prior art outdoor furniture designs:

U.S. Pat. No. 2,567,626—Sept. 11, 1951—Trouslot, Jr.
U.S. Pat. No. 2,855,025—Oct. 7, 1958—Griffith
U.S. Pat. No. Des. 90,866—Oct. 17, 1933—Bielecky
U.S. Pat. No. Des. 233,493—Nov. 5, 1974—Tuttle
U.S. Pat. No. Des. 261,705—Nov. 10, 1981—Land et al The Trouslot patent discloses a reclining lounge chair having a back pivotally connected to a seat and leg portion. Both the back portion and the seat and leg portion include a number of parallel bands which extend lengthwise on the respective portions.

The Griffith patent discloses a folding chair which is adapted to become a cot having supporting straps 62 which are tensioned by hook 70 (FIGS. 9-11).

The Bielecky design patent simply shows a chaise lounge having numerous straps extending lenthwise and three straps extending across the width of the lounge.

The Tuttle design patent discloses a chaise lounge having a centrally located lengthwise extending support member.

The Land et al design patent shows a chaise lounge including several lengthwise extending straps disposed below cover pieces.

Although the prior art has been generally useful at providing various structures for outdoor furniture, prior art designs have generally been subject to one or more of a number of disadvantages.

One disadvantage is that those prior art structures such as picnic benches which may support more than one person are not adjustable into various positions. That is, a picnic bench is generally disposable in only one stable position.

Although various prior art structures such as chaise lounges allow adjustment to various positions and, thereby, provide great flexibility, such chaise lounges or similar adaptable structures usually will not comfortably support more than one adult at a time.

A further problem common to most prior art chaise lounges is that they lack a means whereby the degree of support or firmness provided to the user may be varied depending upon the user's preference.

SUMMARY OF THE INVENTION

Accordingly, it is an object of the present invention to provide a new and useful chaise lounge which is adaptable to support two adults at the same time whether the chaise lounge is in a cot position or a recliner position.

Another object of the present invention is to provide a chaise lounge wherein the level of support or firmness may be varied depending upon one's personal preference.

Yet another object of the present invention is to provide a chaise lounge having a structure which will comfortably support two adults, but may be constructed in quite similar fashion to the heretofore known chaise lounges.

These and other objects of the present invention which will become apparent as the description proceeds are realized by a chaise lounge comprising: a planar center frame section including at least two side parts; and first and second end frame sections pivotably attached at opposite ends of the center frame section, each end frame section including at least two side portions and an end portion. The chaise lounge may be disposed in at least two (and preferably many different) positions: (I). a cot position with the first and second end frame sections pivoted to be planar with the center frame section, and (II). a recliner position with the first end frame section extending up from the center frame section to serve as a seat backing and the second end frame section extending down from the center frame section to serve as a leg rest. The chaise lounge further comprises two leg assemblies for supporting the chaise lounge, supporting material extending between the side parts and the end portions, an adjustable support strap extending below the supporting material and between the end portions for supporting the support material when the chaise lounge is disposed in at least the cot position and the recliner position, and adjusting means for changing the effective length of the support strap to control sagging of the supporting material. Each leg assembly includes a U-shaped leg having two vertical side portions and a horizontal bottom portion and with a cross-brace extending between the vertical side portions. The chaise lounge is at least three and one-half feet wide at its center frame section such that two people may sit or lie in the chaise lounge at the same time, and the adjusting means allows different tensions in the supporting strap when the chaise lounge is disposed in the cot position and in the recliner position. The chaise lounge further comprises two diagonal braces in each of the two end frame sections, each diagonal brace extending between a side portion and an end portion. The chaise lounge additionally comprises two tensioning straps attached to the support strap. Each tensioning strap is secured to a corresponding one of the cross-braces. The supporting material comprises interwoven plastic webbing whereas the support strap and tensioning straps are made of canvas.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout several views.

DESCRIPTION OF THE PREFERRED EMBODIMENTS

Considering now the top planar view of FIG. 1 and the cross section view of FIG. 2, a chaise lounge 10 according to the present invention will be discussed in detail.

The chaise lounge 10 includes a planar center frame section 12 having side parts 12F and 12B. A first end frame section 14 includes side portions 14F and 14B and end portion 14E. Likewise, a second end section 16 includes side portions 16F and 16B and end portion 16E. End frame section 16 includes two diagonal braces 16D which extend between the end portion 16E and each of the two side portions 16F and 16B. Similarly, diagonal braces 14D are disposed at both outside corners of the first end frame section 14.

Figure 1:
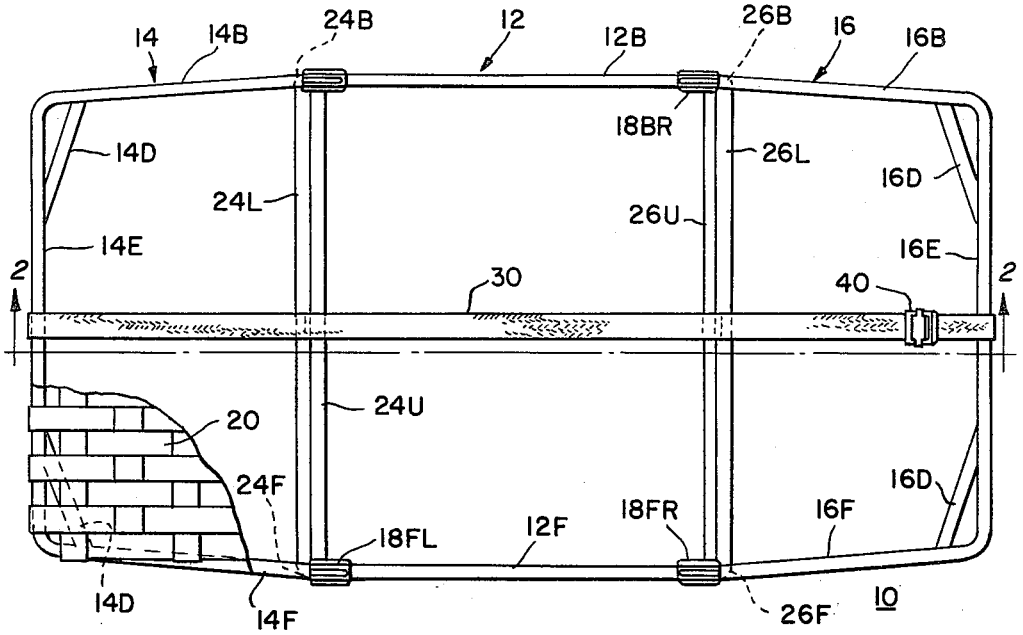
FIG. 1 shows a top planar view of the chaise lounge of the present invention.
Figure 2:
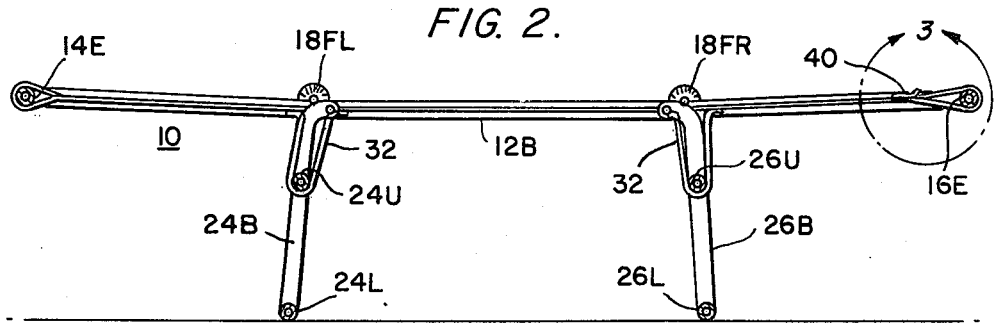
FIG. 2 shows a side cross section view of the present invention taken along lines 1—1 of FIG. 1.

As shown in FIG. 1 plastic webbing supporting material 20 may include plastic straps which extend lengthwise and widthwise and which are interwoven in a basket weave fashion. The plastic straps are secured to the various frame members, each lengthwise extending strap completely traversing from end portion 14E to end portion 16E and each widthwise strap completely traversing from 12F, 14F, or 16F respectively to 12B, 14B, or 16B. It will be readily appreciated that the plastic webbing supporting material 20 is only shown in one corner of FIG. 1 in order to clearly illustrate other features of the present invention.

Vertical leg side portions 24F and 24B, which are connected by corresponding leg cross-brace 24U and horizontal bottom leg portion 24L, support the chaise lounge 10 on one side. The leg including vertical leg side portions 24F and 24B and horizontal leg bottom portion 24L are integrally made from a single piece of tubing bent square to a "U" shape with cross brace 24 U bolted or otherwise attached for strength. The other side of the chaise lounge is supported by a leg assembly of side portions 26F and 26B and bottom portion 26L and leg cross-brace 26U and constructed identically to the leg assembly of 24F, 24B, 24U, and 24L.

Disposed at the interface between the center frame section 12 and the first end frame section 14 are two universal type adjustable brackets 18FL and 18BL as are commonly used on banana type chaise lounges. Likewise, universal type adjustable brackets 18BR and 18FR are disposed in between the center section 12 and the second end section 16. The brackets allow the first end section 14 to be pivoted upwardly from the cot position (end sections 14 and 16 disposed in the plane of center section 12) to serve as a seat backing, whereas the second end section 16 may be pivoted to extend downwardly from the plane of the center section 12, thereby realizing a leg rest. By virtue of the adjustable brackets, the chaise lounge 10 may be disposed in a number of different positions in a fashion similar to known chaise lounges.

The chaise lounge 10 of the present invention is at least three and one-half (3½) feet wide at the center frame section 12 such that two people may sit or lie in the chaise lounge at the same time. More specifically, the chaise lounge 10 will preferably measure 72 inches by 42 inches width.

In order to accommodate two adults on the chaise lounge 10 at the same time, the present invention uses an adjustable supporting strap 30 which is secured at one end to end portion 14E and extends lengthwise along the chaise lounge to end portion 16E. An adjusting means 40 may be used to tighten or loosen the tension on the strap 30 to provide different levels of support. Cross brace straps 32 are fastened to the main canvas supporting strap 30 and looped around the leg cross-braces 24U and 26U. The cross brace straps 32 prevent the supporting strap 30 from being pulled too high when end section 14 (or end section 16) is pivoted upwardly to serve as a seat back.

Figure 3:
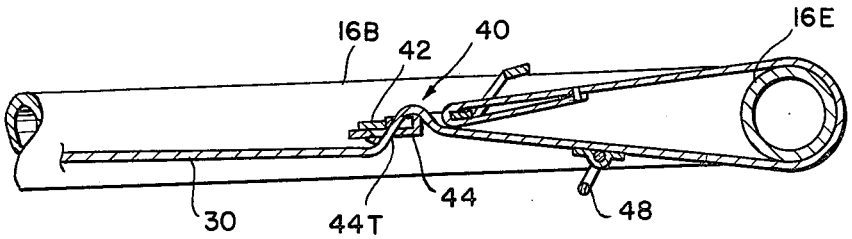
FIG. 3 shows an enlarged cross-section of the adjuster used for the present invention.

Turning now to FIG. 3, the details of the adjusting means or adjuster 40 will be discussed. In particular, the main canvas strap 30 is adjustable by adjusting the effective length of the strap between the two end portions 14E and 16E. The adjuster 40 includes a frame member 42 having a slider member 44 with a teeth portion 44T on one side thereof. An adjustment ring 48 may be used to tighten the tension on the main canvas supporting strap 30 as by decreasing the effective length of the supporting strap 30. In particular, the adjusting ring 48 may be pulled to the right in FIG. 3 to increase the tightness of the strap 30. The teeth 44T will prevent the strap 30 from loosening when someone sits on the chaise lounge 10. Other adjusters which allow for the various positions of the chaise lounge 10 could also be used.

Since the support strap is under high tension, the diagonal braces 14D and 16D are used to buttress the strength of the frame.

The frame of the chaise lounge 10 may best be realized by using ¾ inch hollow tubular steel, whereas the supporting strap 30 and cross brace straps 32 are best realized by three-inch canvas straps. The plastic webbing 20 which is commonly used on outdoor lounge furniture is preferably fastened with rust-proof metal screws and flat washers (not shown) in a fashion well known in the art. Instead of use of the plastic webbing 20, other coverings such as solid plastic strapping or tubular plastic attached by heat welding could be used.

Although various specific materials and/or constructions have been illustrated herein, these details are for illustrative purposes only. It will readily be understood that various modifications and adaptations will be apparent to those of ordinary skill in the art. Accordingly, the true scope of the present invention should be determined by the claims appended hereto.

What is claimed is:

1. A chaise lounge comprising:

a planar center frame section including at least two side parts;

first and second end frame sections pivotably attached at opposite ends of said center frame section, each end frame section including at least two side portions and an end portion, and the chaise lounge may be disposed in at least two positions:

I. a cot position with said first and second end frame sections pivoted to be planar with the center frame section; and II. a recliner position with said first end frame section extending up from said center frame section to serve as a seat backing and said second end frame section extending down from said center frame section to serve as a leg rest;

legs for supporting the chaise lounge; supporting material extending between said side parts and said end portions; an adjustable support strap extending below said supporting material and between said end portions for supporting said support material when the chaise lounge is disposed in at least said cot position and said recliner position; and an adjustor for changing the tension on of said support strap to control sagging of said support material;

wherein the chaise lounge is at least three and one-half feet wide at said center frame section such that two people may sit or lie in the chaise lounge at the same time, and said adjustor allows different tensions in said supporting strap when the chaise lounge is disposed in said cot position and said recliner position, and further comprising two leg cross braces, and two cross brace straps attached to said support strap and each cross brace strap secured to a corresponding one of said cross leg braces.

2. The chaise lounge of claim 1 further comprising two diagonal braces in each of said two end frame sections, each diagonal brace extending between a side portion and an end portion.

3. The chaise lounge of claim 1 wherein said supporting material comprises interwoven plastic webbing.

4. A chaise lounge comprising:

a planar center frame section including at least two side parts;

first and second end frame sections pivotably attached at opposite ends of said center frame section, each end frame section including at least two side portions and an end portion, and the chaise lounge may be disposed in at least two positions:

I. a cot position with said first and second end frame sections pivoted to be planar with the center frame section; and II. a recliner position with said first end frame section extending up from said center frame section to serve as a seat backing and said second end frame section extending down from said center frame section to serve as a leg rest;

legs for supporting the chaise lounge; supporting material extending between said side parts and said end portions; an adjustable support strap extending below said supporting material and between said end portions for supporting said support material when the chaise lounge is disposed in at least said cot position and said recliner position; and an adjustor for changing the tension on of said support strap to control sagging of said supporting material;

wherein the chaise lounge is at least three and one-half feet wide at said center frame section such that two people may sit or lie in the chaise lounge at the same time, and said adjustor allows different tensions in said supporting strap when the chaise lounge is disposed in said cot position and said recliner position, wherein said supporting material comprises interwoven plastic webbing, and wherein there are two legs, each leg including two vertical side portions and a horizontal bottom portion; and further comprising two leg cross braces, each cross brace extending between vertical side portions of a corresponding leg; two cross brace straps attached to said support strap and each cross brace step secured to a corresponding one of said leg cross braces; and two diagonal braces in each of said two end frame sections, each diagonal brace extending between a side portion and an end portion.

5. The chaise lounge of claim 4 wherein said support strap and said cross brace straps are made of canvas.

* * * * *